US007174939B1

(12) United States Patent
Spencer

(10) Patent No.: US 7,174,939 B1
(45) Date of Patent: Feb. 13, 2007

(54) WINDOW

(76) Inventor: John M. Spencer, 1020 S. 8th St., Lincoln, NE (US) 68508

( * ) Notice: Subject to any disclaimer, the term of this patent is extended or adjusted under 35 U.S.C. 154(b) by 214 days.

(21) Appl. No.: 10/850,790

(22) Filed: May 21, 2004

(51) Int. Cl.
*A47H 1/00* (2006.01)

(52) U.S. Cl. ..... 160/90; 49/63

(58) Field of Classification Search ..... 160/90, 160/91, 92; 49/63, 61, 504; 52/202, 204.51
See application file for complete search history.

(56) References Cited

U.S. PATENT DOCUMENTS

| | | | | |
|---|---|---|---|---|
| 1,111,621 A | | 9/1914 | Singer | |
| 1,406,786 A | | 2/1922 | Ward | |
| 1,855,806 A | | 4/1932 | Marschke | |
| 2,699,825 A | | 1/1955 | Stritzler | 160/90 |
| 3,466,806 A | | 9/1969 | Teggelaar et al. | 49/445 |
| D216,958 S | | 3/1970 | Dallaire | D13/6 |
| 4,074,483 A | * | 2/1978 | Vickstrom | 52/202 |
| 4,199,900 A | | 4/1980 | Johnston et al. | 49/404 |
| 4,274,468 A | * | 6/1981 | McPhail | 160/90 |
| 4,326,360 A | | 4/1982 | Davidson | 49/63 |
| 5,253,457 A | * | 10/1993 | Orth | 52/202 |
| 5,526,608 A | | 6/1996 | Stark | 49/419 |
| 5,649,389 A | | 7/1997 | Coddens | 49/419 |

FOREIGN PATENT DOCUMENTS

GB 1006620 10/1965

* cited by examiner

*Primary Examiner*—David Purol
(74) *Attorney, Agent, or Firm*—Thomte, Mazour & Niebergall; Shane M. Niebergall

(57) ABSTRACT

A window design is provided with a pair of vertical jambs, a head jamb, a meeting rail and a sill. In one embodiment, an upper sash is secured in a fixed position between the vertical jambs, head jamb and meeting rail. Interior jambs are provided to extend outwardly from interior faces of the window frame and slidably receive a lower sash that is selectively moved between open and closed positions. A screen may be optionally secured to the exterior face of the window frame to allow the simultaneous use of the screen and the sliding lower sash. The window design retains a historic exterior appearance of the window while providing improved conveniences and durability.

28 Claims, 6 Drawing Sheets

WINDOW

BACKGROUND OF THE INVENTION

1. Field of the Invention

The present invention relates to windows and more particularly to a single-hung window that simultaneously incorporates the use of a lower screen member with a vertically positionable lower sash without revealing the operating features for either the lower screen member or the &lower sash member to an observer who is standing in front of the exterior face of the window.

2. Description of the Prior Art

A common window design found within early $20^{th}$ century and older homes provided a simple removable window frame having a pair of horizontally spaced side jambs, a head jamb located at the upper end of the side jambs, a sill disposed at the lower end of the side jambs and a meeting rail extending between the side jambs intermediate the head jamb and sill. The window frame formed upper and lower window openings that were covered with glass panes or screens. Accordingly, two separate windows were required for year round use with this window design. When the weather turned cold or stormy, the window having glass panes disposed within the window openings would be used. As the weather became warm in the Spring and Summer months, the glass-paned window would be removed and stored while a completely separate window, having screens in place of the window panes would be positioned in its place. Accordingly, the window design proved to be tedious during the Fall and Spring seasons when the homeowners might want to exchange one lower sash for the other as the temperatures and weather conditions varied back and forth.

Another flaw in the window design prevented the homeowner from varying the degree in which the window was opened. Unlike the convenient single or double-hung windows currently being used, the historic storm window was either open or closed. Moreover, regardless of whether the window is opened or closed, the homeowner had to store the window that was not being used. While this is not a serious inconvenience for a single window, it was common for a home to have several windows on each floor that would have a counterpart window that had to be stored. Accordingly, a homeowner may have to store ten or more complete window units at any given time.

The restoration of historic homes, as well as the construction of new homes having historic exterior designs, has become a growing industry and popular cultural trend. Oftentimes, the windows must be restored or replaced. What is needed is a window design that provides a replacement window for historic structures that resembles the exterior appearance of the structure's original windows, but also provides several of the conveniences found within modern single-hung windows. Moreover, the novel window design should provide a manner in which an existing window within a historic structure can be restored to include basic modern conveniences while retaining some of its historic exterior appearance.

SUMMARY OF THE INVENTION

The window design of the present invention is first provided with a window frame having a pair of vertical jambs coupled with a head jamb, meeting rail and lower rail. In a preferred embodiment, an upper sash is secured in a fixed position between the vertical jambs, the head jamb and the meeting rail. A pair of interior jambs are provided to extend outwardly from an interior face of each vertical jamb. In a preferred embodiment, an interior lower rail is provided to extend outwardly from an interior face of the window frame lower rail. A lower sash having upper and lower rails and opposing stiles is provided to slide within the interior jambs between open and closed positions.

In one preferred embodiment, weatherstripping is coupled to the interior jambs and the interior lower rail to resist the infiltration of the elements and to provide a snug fit for the lower sash as it is moved between its open and closed positions. In another preferred embodiment, a pair of latch pins are provided at the lower end portion of the lower rail to provide a means with which the user can secure the lower sash in one of a plurality of different vertical positions along the lengths of the interior jambs. The interior jambs and lower rail may be anchored within channels formed in the interior faces of the window frame using press-fit anchors that extend outwardly from the interior jambs and lower rail. A screen panel may be secured within the exterior face of the window frame to provide simultaneous use of the lower sash and the screen panel.

It is therefore one of the principal objects of the present invention to provide a window design that resembles a historic storm window while permitting the simultaneous use of a lower sash and a screen panel.

A further object of the present invention is to provide a window design that provides a lower sash that is vertically slid between open and closed positions while retaining a historic exterior appearance.

Still another object of the present invention is to provide a window design that resembles a historic storm window but provides a vertically sliding lower sash that substantially prevents the unintended infiltration of the wind and elements.

Yet another object of the present invention is to provide a window design having an exterior appearance that is similar to a historic storm window while providing a vertically moveable lower sash and increasing the torsional stability and trueness of the window frame.

Still another object of the present invention is to provide a method of restoring a historic storm window which incorporates the convenience of a sliding lower sash while generally retaining the historic exterior appearance of the window.

A further object of the present invention is to provide a window design that enables an individual to modify an existing historic storm window to include a permanent screen panel and a sliding lower sash without departing greatly from the historic exterior appearance of the window.

These and other objects of the present invention will be apparent to those skilled in the art.

DESCRIPTION OF THE PREFERRED EMBODIMENT

Figure 1:
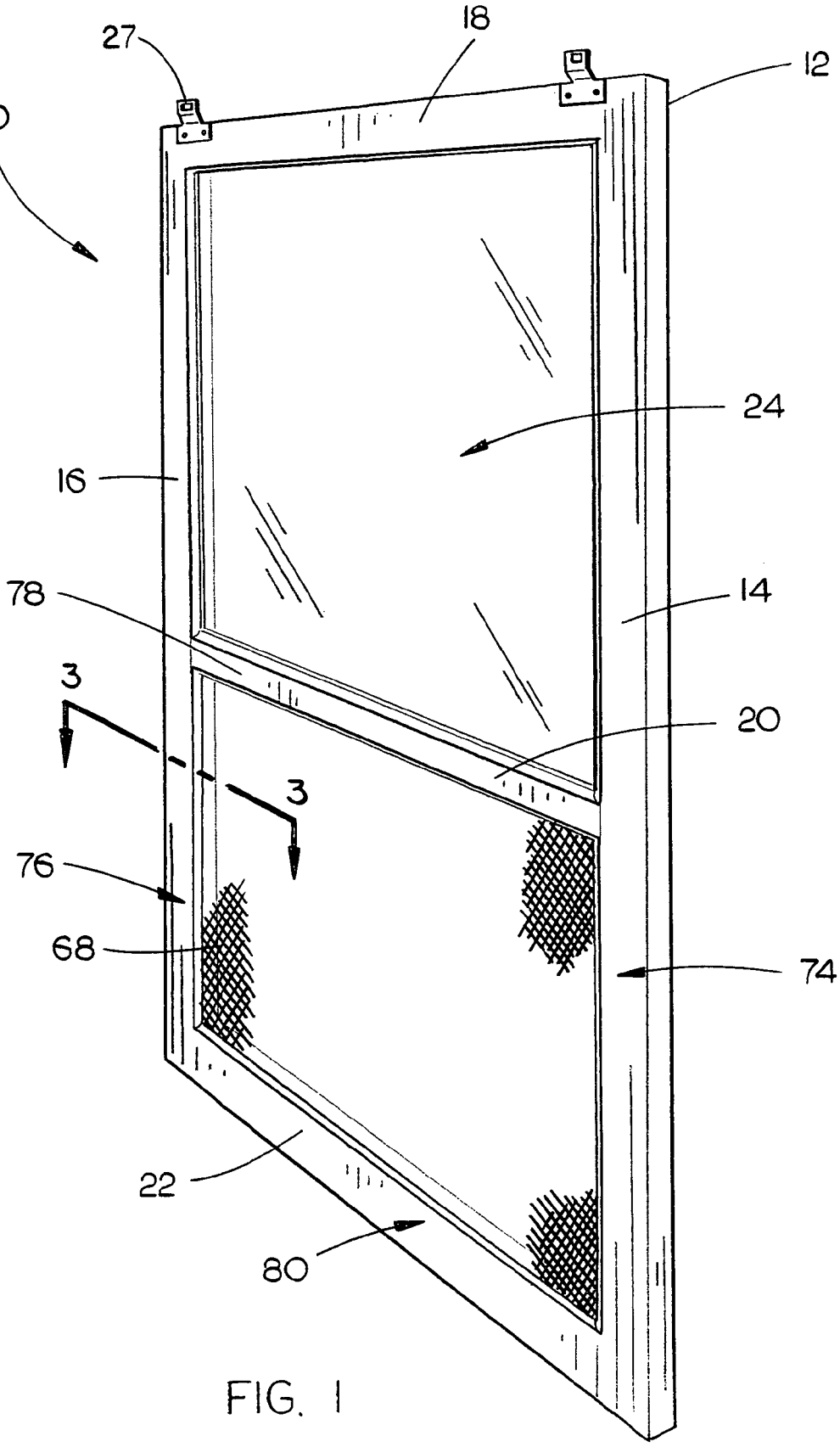
FIG. 1 is an isometric view of the exterior face of one embodiment of the window of the present invention.
Figure 2:
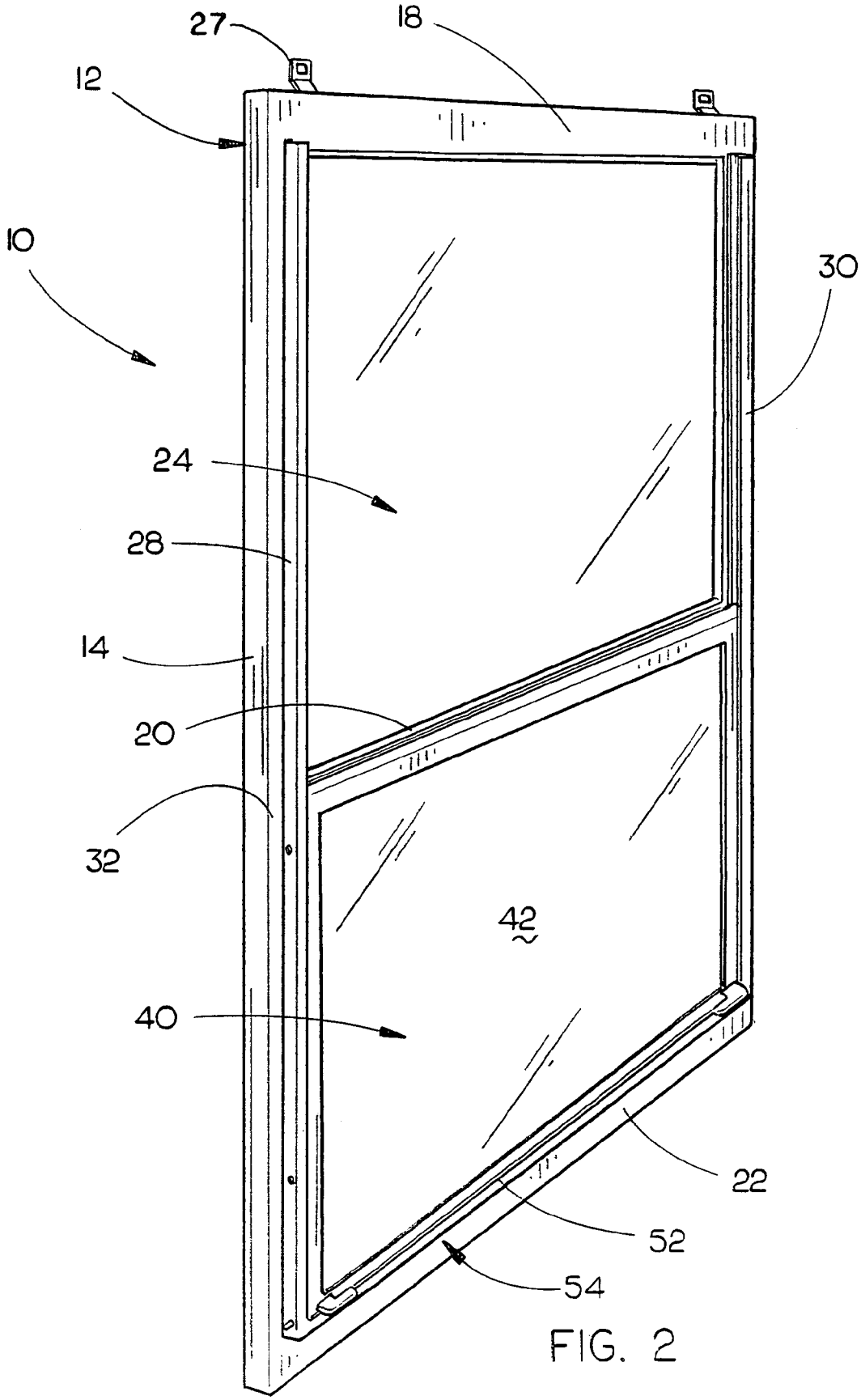
FIG. 2 is an isometric view of the interior exterior face of one embodiment of the window of the present invention.
Figure 3:
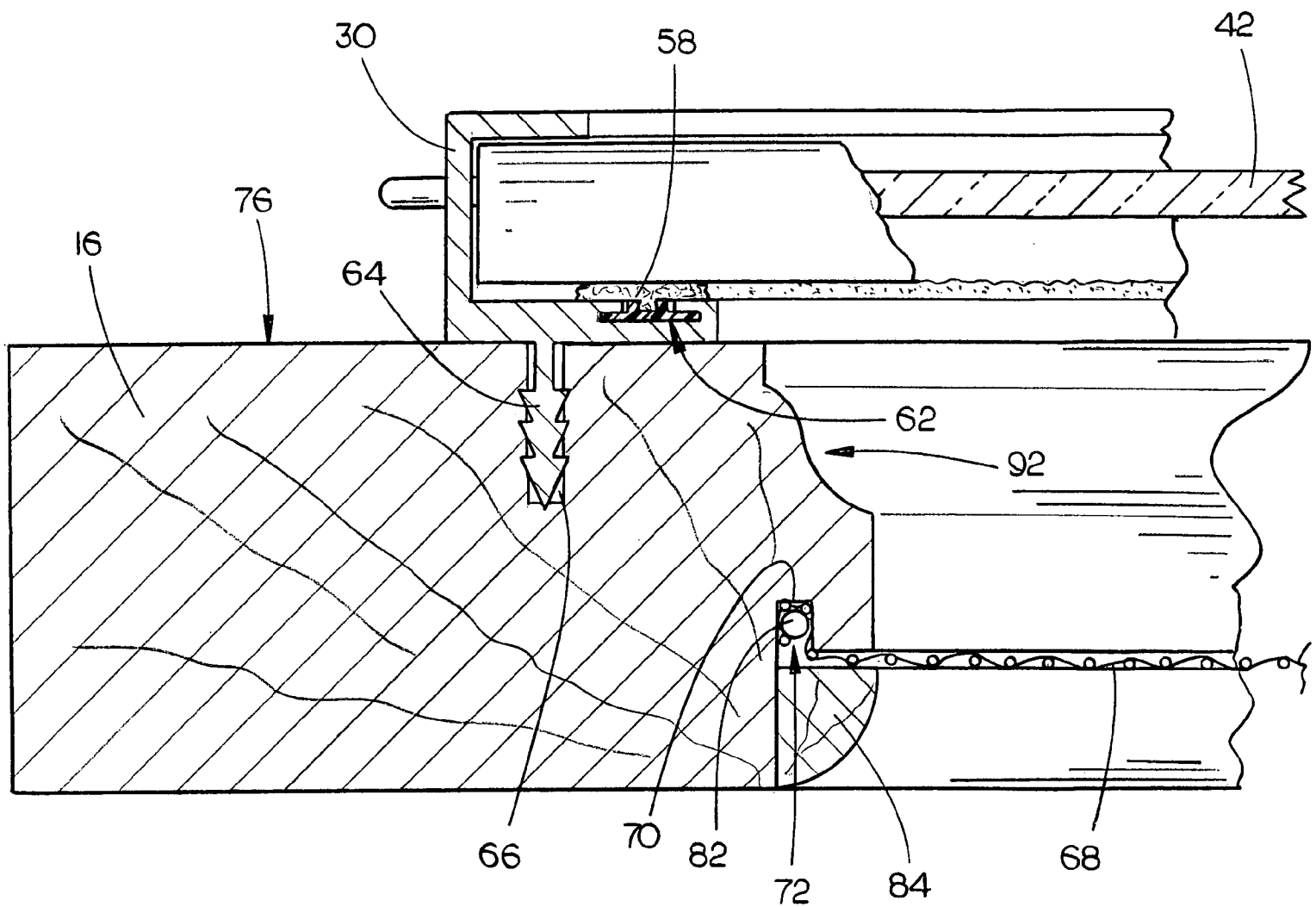
FIG. 3 is a partial sectional view of one embodiment of the window of the present invention.
Figure 4:
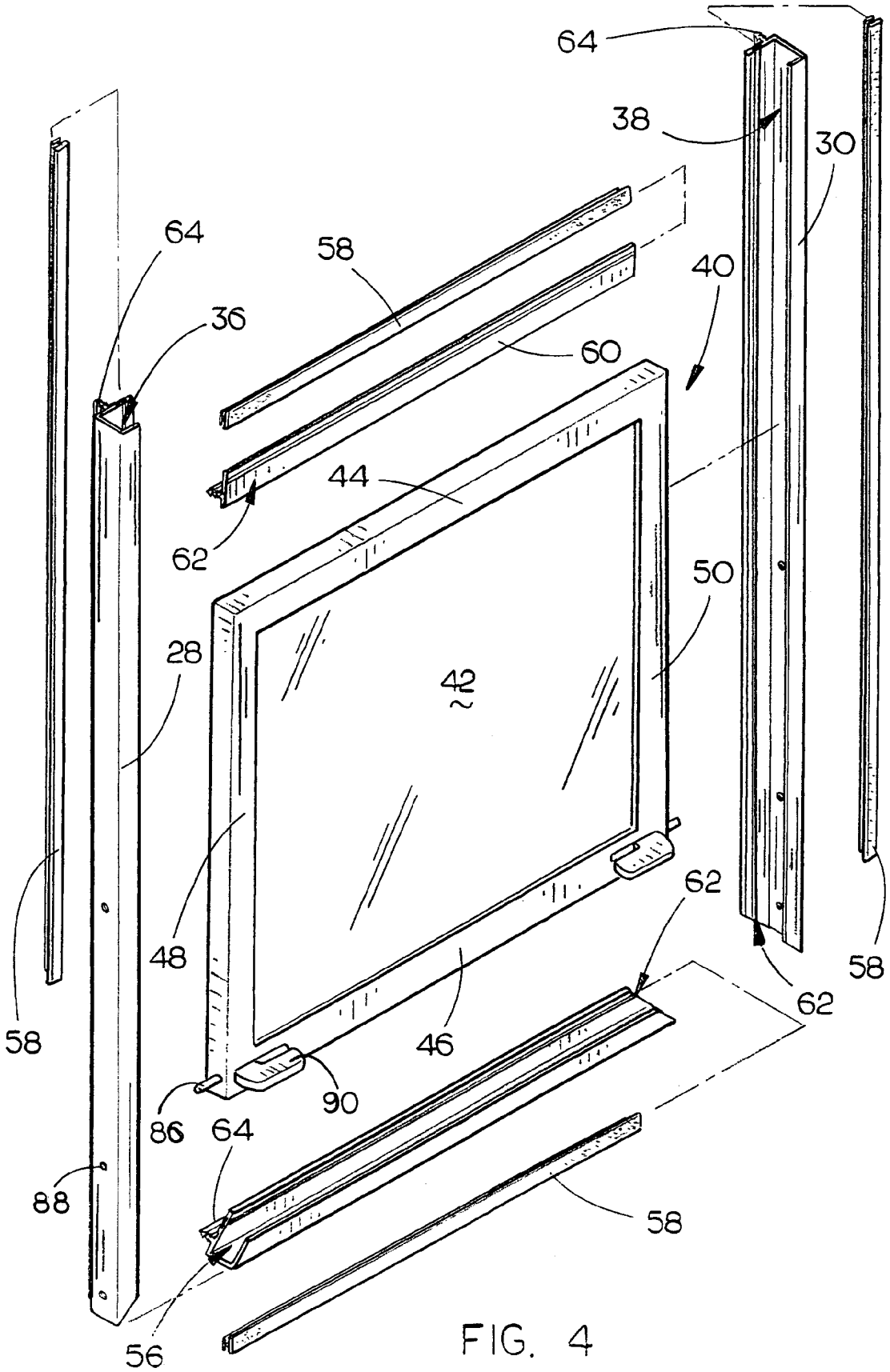
FIG. 4 is a partial exploded view of one embodiment of the window of the present invention.
Figure 5:
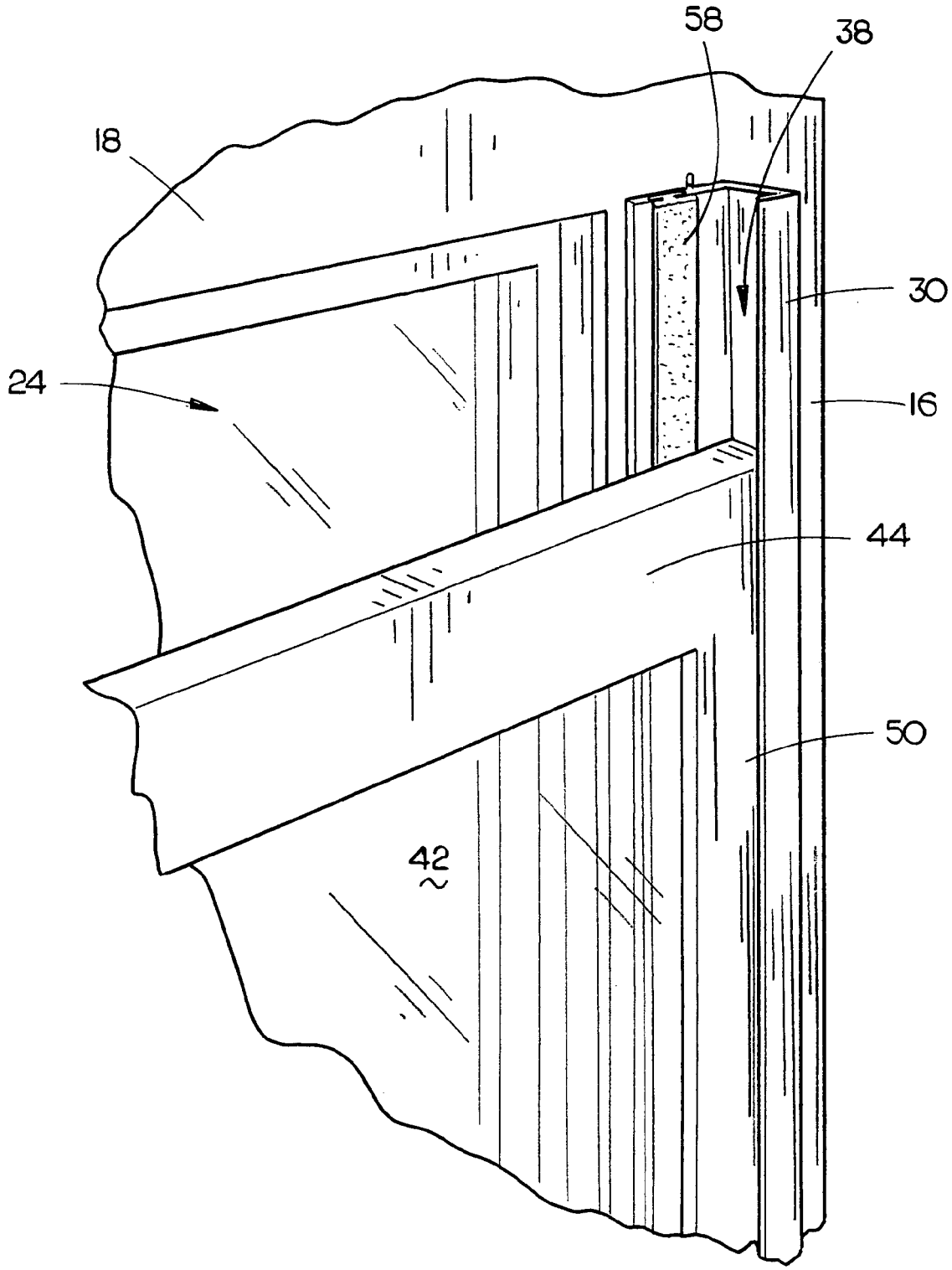
FIG. 5 is a partial view of the window of the present invention with the lower sash in an open position.
Figure 6:
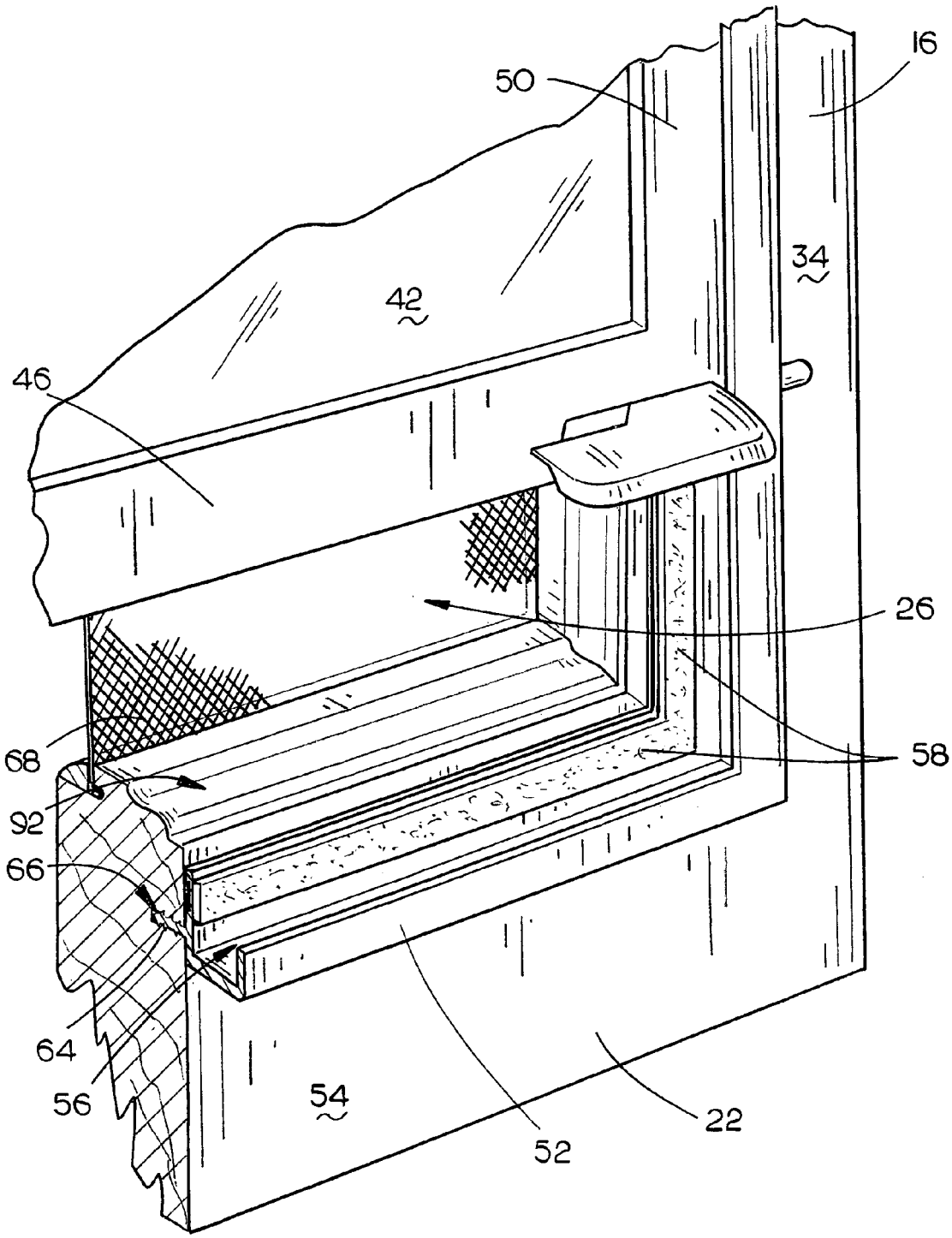
FIG. 6 is another partial view of the window of the present invention with the lower sash in an open position.

The window 10 of the present invention is generally depicted in FIGS. 1–6 and is described herein as a single-hung design. However it is contemplated that the design of the window 10 would easily permit its construction as a double-hung window, in those particular circumstances where such a design would be desirable. For ease of description, the window 10 is described as a replacement or new construction window, it will be clear to those having skill in the art that the structures and principles of the window 10 could be easily applied in modifying existing historic or modern windows.

The window 10 is provided with a window frame 12 having a first vertical jamb 14 and a second vertical jamb 16 that are spaced horizontally from one another. A head jamb 18 is coupled to the upper end portions of the first and second vertical jambs 14 and 16. A meeting rail 20 extends between the first and second vertical jambs 14 and 16 intermediate their upper and lower end portions. A lower rail 22 is coupled to the lower end portions of the first and second vertical jambs 14 and 16. In a preferred embodiment, an upper sash 24 is secured in a fixed position between the first and second vertical jambs 14 and 16 and the head jamb 18 and meeting rail 20. The first and second vertical jambs 14 and 16 combine with the meeting rail 20 and lower rail 22 to define a window opening 26. Stylistically, the window frame 12 could be provided in various shapes and in a wide range of dimensions. For example, the window frame 12 may be crafted to closely resemble a window frame from a historic storm window that exhibits a particular period appearance. Hardware, such as the hangers 27 depicted in FIGS. 1 and 2, may be used to selectively removably secure the window 10 within the opening of a window casing.

In a preferred embodiment, first and second interior jambs 28 and 30 extend outwardly from interior faces 32 and 34 of the first and second vertical jambs 14 and 16. In this manner, the first and second interior jambs would extend into the room of the building to which the window 10 is secured. The first and second interior jambs 28 and 30 are shaped to provide channels 36 and 38 that extend along at least a portion of the length of the first and second interior jambs 28 and 30. The channels 36 and 38 are positioned within the first and second interior jambs 28 and 30 to generally face one another in a coplanar manner so that they may slidably receive the side portions of a lower sash 40. In its preferred embodiment, the lower sash 40 is provided with a glass pane 42 that is framed by upper and lower rails 44 and 46 and first and second stiles 48 and 50. It is contemplated that such rails and stiles may be comprised of structures separate and apart from the glass pane 42 and formed from nearly any material such as various metals, woods and polymers. However, it is also contemplated that the rail and stile portions of the lower sash 40 could simply be the peripheral ledge portions of the glass pane 42 itself in particular applications. Regardless, the lower sash 40 is selecting moveable within the channels 36 and 38 between open and closed positions.

An interior lower rail member 52 may be provided to extend outwardly from an interior face 54 of the window lower rail 22. The interior lower rail member 52 is shaped to have a channel 56 extending along at least a portion of its length, much in the same manner as the channels 36 and 38 are formed within the first and second interior jambs 28 and 30. The channel 56 preferably faces in a generally upward direction and positioned in a coplanar manner with the channels 36 and 38 so that at least a portion of the lower rail 46 of the lower sash 40 is received within the channel 56 when the window 10 is in a closed position.

Due to the advent of various extruded materials and precise shaping processes, it is contemplated that the lower sash 40 will be slidably received within the channels 36, 38 and 56 in such a manner that wind and other weather elements are substantially prevented from passing there between. Moreover, the first and second interior jambs 28 and 30 and interior lower rail member 52 should be formed from various modern materials that are durable while exhibiting low coefficients of friction for smooth and easy manipulation of the lower sash 40 over the lifetime of the window 10. However, lengths of weatherstripping 58 can be provided where the lower sash 40 engages the first and second interior jambs 28 and 30, the interior lower rail member 52 and the meeting rail 20 to further ease the sliding action. In one embodiment, the lengths of weatherstripping 58 are secured along a portion of the channels 36, 38 and 56, as well as the meeting rail 20 using an adhesive or other structural securement means, such as tacks and the like. Similarly, the lengths of weatherstripping 58 can be adhered to the upper and lower rails 44 and 46 and the first and second stiles 48 and 50 of the lower sash 40 to achieve a similar sealing engagement with the channels 36, 38 and 56. A mounting plate 60 may be secured to the meeting rail 20 to receive a length of weatherstripping 58.

In a preferred embodiment, slots 62 are formed along channels 36, 38 and 56 as well as the mounting plate 60. The slots 62 should be shaped to receive the rearward surface of the particular type of weatherstripping being used. For example, common felt weatherstripping is provided with a narrow strip of backing material that is easily disposed within T-shaped slots and are easily secured in their positions, with or without adhesives, due to the structural mating of the T-shaped slots and the weatherstripping. A nearly limitless number of different shapes, such as dovetail, elliptical, and the like could be incorporated with the slots 62 depending on the particular application and type of weatherstripping being employed. Such design flexibility is desirable due to the wide range of available materials that would suffice for use in constructing the lengths of weatherstripping 58, such as rubber, polymers, synthetic materials and various combinations thereof.

Where the window 10 is provided as a new or replacement window, it is contemplated that the first and second interior jambs 28 and 30 and the interior lower rail member 52 could be integrally formed with their respective first and second vertical jambs 14 and 16 and window lower rail 22 whether the structural components are formed from metal, wood, plastic or various combinations thereof. However, in many cases the first and second interior jambs 28 and 30 and interior lower rail member 52 will be separate parts that are secured to the interior faces of the first and second vertical jambs 14 and 16 and window lower rail 22. The method of securement will depend upon the particular application. While various adhesives are contemplated, conventional fasteners, such as nails and screws may be preferred. However, in one preferred embodiment, shaped anchors 64 can be provided to extend outwardly from the mounting surfaces of the first and second interior jambs 28 and 30 and the interior lower rail member 52 so that they are secured within anchor recesses 66 formed within the interior faces of the window frame 12. It is contemplated that the shapes of the anchors 64 can vary greatly from those depicted in the Figures. However, shapes that permit the anchors 64 to be press-fit within the anchor recesses 66, while resisting extraction, are preferred. Similarly, while the anchor 64 could be provided as an elongated, continuous member that is received within a channel-shaped anchor recess 66, it is contemplated that the anchor 64 could be more prong-shaped and received within a smaller individual anchor recess. An added benefit to the use of the separate first and second interior jambs 28 and 30 and the interior lower rail member 52 is an increase in the torsional stability and trueness of the first and second vertical jambs 14 and 16 and the window lower rail 22 over the life of the window 10. This structural bracing is provided without a dramatic increase overall structural weight or complexity.

An optional screen member 68 may be simultaneously incorporated with the use of the lower sash 40. In a preferred embodiment, a peripheral edge portion 70 of the screen member 68 is disposed within channels 72 that are formed within the exterior faces 74 and 76 of the first and second vertical jambs 14 and 16 and the exterior faces 78 and 80 of the meeting rail 20 and window lower rail 22. An elongated spline 82 may be used to secure the peripheral edge portion 70 of the screen 68 within the channels 72. To provide a finished appearance to the exterior of the window 10, molding 84 can be applied above the spline 82 to closely resemble the molding or glazing used on the adjacent upper sash 24.

Several different means for securing the lower sash 40 in one of several different open positions and a closed position may be provided. In a preferred embodiment depicted in FIG. 6, a pin member 86 extends outwardly from each of the first and second stiles of the lower sash 40. The pin members 86 should be slidably engageable with a plurality of openings 88 formed within the channels 36 and 38 in the first and second interior jambs 28 and 30. The openings should be positioned in opposing pairs along the lengths of the channels 36 and 38 at a closed position and one or more open positions where the lower sash 40 is disposed in different open positions that reveal varying degrees of the window opening 26. In a preferred embodiment, the pin members 86 are each operatively connected to tabs 90 that may be selectively grasped by a user to manipulate the pin members 86 into and out of engagement with the openings 88. The tabs 90 also provide an optional structure with which the user may lift and pull the lower sash 40 between open and closed positions. It is contemplated that the pin members 86 could be outwardly biased by springs to assist the user in locating the openings 88.

The design of the window 10 presents few changes to the exterior appearance of the window being replaced or remodeled. To further enhance the exterior appearance of the window 10, a shaped profile 92, such as an ogee may be formed along the peripheral edge of the window opening 26, adjacent the first and second interior jambs 28 and 30, as well as the interior lower rail member 52 and the mounting plate 60 to provide the optical illusion that the lower sash 40 is not actually disposed behind the window frame 12. Accordingly, when the exterior of the window 10 is viewed at various angles, it appears as though the lower sash 40 is disposed within the window opening 26 in a manner similar to historic storm windows.

In the drawings and in the specification, there have been set forth preferred embodiments of the invention and although specific items are employed, these are used in a generic and descriptive sense only and not for purposes of limitation. Changes in the form and proportion of parts, as well as a substitution of equivalents, are contemplated as circumstances may suggest or render expedient without departing from the spirit or scope of the invention as further defined in the following claims.

Thus it can be seen that the invention accomplishes at least all of its stated objectives.

I claim:

1. In combination a window casing, comprising an upper casing member, a lower casing member and a pair of opposite side casing members, which together define a casing opening;

a window, selectively removably securable within said casing opening, the window comprising:

a frame having at least first and second vertical jambs, a head jamb, meeting rail and lower rail;

an upper sash positioned between said first and second vertical jambs and between said head jamb and said meeting rail;

first and second interior jambs extending outwardly from an interior face of said first and second vertical jambs; and a lower sash having upper and lower rails and opposing first and second stiles; said first and second stiles being slidably received by channels formed within said first and second interior jambs so that said lower sash may be selectively moved between open and closed positions.

2. The combination of claim 1 further comprising an interior lower rail extending outwardly from an interior face of said lower rail and having a channel that is shaped to operatively engage the lower rail of said lower sash when said lower sash is in said closed position.

3. The combination of claim 1 further comprising lengths of weatherstripping operatively coupled to said first and second interior jambs so that said lower sash operatively engages said lengths of weatherstripping when said lower sash is in said closed position.

4. The combination of claim 2 further comprising lengths of weatherstripping operatively coupled to said first and second interior jambs and said interior lower rail so that said lower sash engages said lengths of weatherstripping when said lower sash is in said closed position.

5. The combination of claim 4 further comprising a length of weatherstripping that is operatively coupled to said meeting rail so that said lower sash engages said length of weatherstripping when said lower sash is in said closed position.

6. The combination of claim 4 wherein said lengths of weatherstripping are at least partially received within slots formed within said first and second interior jambs and said interior lower rail.

7. The combination of claim 6 wherein the length of weatherstripping operatively coupled to said meeting rail is at least partially received within a slot formed within a mounting plate coupled to said meeting rail.

8. The combination of claim 1 further comprising means for selectively securing said lower sash in said closed position and at least one open position.

9. The combination of claim 1 wherein said first and second interior jambs are provided with anchors that extend outwardly from said first and second interior jambs and are secured within recesses formed in said interior faces of said first and second vertical jambs to secure said first and second interior jambs to said first and second vertical jambs.

10. The combination of claim 9 further comprising an interior lower rail extending outwardly from an interior face of said lower rail and having a channel that is shaped to operatively engage the lower rail of said lower sash when said lower sash is in said closed position.

11. The combination of claim 10 wherein said interior lower rail is provided with at least one anchor that extends outwardly from said interior lower rail so that it is secured within at least one recess formed within said lower rail to secure said interior lower rail to said interior face of said lower rail.

12. The combination of claim 11 further comprising lengths of weatherstripping operatively coupled to said first and second interior jambs and said interior lower rail so that said lower sash engages said lengths of weatherstripping when said lower sash is in said closed position.

13. The combination of claim 12 further comprising a length of weatherstripping that is operatively coupled to said meeting rail so that said lower sash engages said length of weatherstripping when said lower sash is in said closed position.

14. The combination of claim 13 wherein said lengths of weatherstripping are at least partially received within slots formed within said first and second interior jambs and said interior lower rail.

15. The combination of claim 14 wherein the length of weatherstripping operatively coupled to said meeting rail is at least partially received within a slot formed within a mounting plate coupled to said meeting rail.

16. The combination of claim 15 wherein said mounting plate is provided with an anchor that extends outwardly from said mounting plate and is secured within a recess formed within an interior face of said meeting rail.

17. The combination of claim 16 further comprising means for selectively securing said lower sash in said closed position and at least one open position.

18. The combination of claim 17 further comprising a screen that is operatively coupled to exterior faces of said first and second vertical jambs, said meeting rail and said lower rail.

19. The combination of claim 18 wherein at least a portion of said screen is at least partially received within channels formed within said exterior faces of said first and second vertical jambs, said meeting rail and said lower rail.

20. The combination of claim 1 further comprising a screen that is operatively coupled to exterior faces of said first and second vertical jambs, said meeting rail and said lower rail.

21. The combination of claim 20 further comprising an interior lower rail extending outwardly from an interior face of said lower rail and having a channel that is shaped to operatively engage the lower rail of said lower sash when said lower sash is in said closed position.

22. The combination of claim 21 further comprising lengths of weatherstripping operatively coupled to said first and second interior jambs and said interior lower rail so that said lower sash engages said lengths of weatherstripping when said lower sash is in said closed position.

23. The combination of claim 22 further comprising a length of weatherstripping that is operatively coupled to said meeting rail so that said lower sash engages said length of weatherstripping when said lower sash is in said closed position.

24. The combination of claim 23 wherein said lengths of weatherstripping are at least partially received within slots formed within said first and second interior jambs and said interior lower rail.

25. The combination of claim 24 wherein the length of weatherstripping operatively coupled to said meeting rail is at least partially received within a slot formed within a mounting plate coupled to said meeting rail.

26. The combination of claim 25 wherein said mounting plate is provided with an anchor that extends outwardly from said mounting plate so that it is received within a recess formed within an interior face of said meeting rail.

27. The combination of claim 26 wherein at least a portion of said screen is received within channels formed within said exterior faces of said first and second vertical jambs, said meeting rail and said lower rail.

28. The combination of claim 27 further comprising means for selectively securing said lower sash in said closed position and at least one open position.

* * * * *